US008269804B2

(12) United States Patent
Nishida et al.

(10) Patent No.: US 8,269,804 B2
(45) Date of Patent: Sep. 18, 2012

(54) IMAGE DISPLAY APPARATUS AND METHOD FOR CORRECTING COLOR SIGNALS BASED ON A SUB-PIXEL LOCATION AND A POSITION OF A VIEWER

(75) Inventors: Koji Nishida, Tokyo (JP); Mitsuyasu Asano, Tokyo (JP); Kazuhiko Ueda, Kanagawa (JP)

(73) Assignee: Sony Corporation, Tokyo (JP)

( * ) Notice: Subject to any disclaimer, the term of this patent is extended or adjusted under 35 U.S.C. 154(b) by 1100 days.

(21) Appl. No.: 11/600,780

(22) Filed: Nov. 17, 2006

(65) Prior Publication Data

US 2007/0120876 A1 May 31, 2007

(30) Foreign Application Priority Data

Nov. 25, 2005 (JP) ..... P2005-339578

(51) Int. Cl.
*G09G 5/10* (2006.01)

(52) U.S. Cl. ..... 345/694

(58) Field of Classification Search ..... 345/690–694, 345/214, 89, 589; 382/276–308; 708/300, 708/403–425

See application file for complete search history.

(56) References Cited

U.S. PATENT DOCUMENTS

| | | | | |
|---|---|---|---|---|
| 6,825,835 | B2 * | 11/2004 | Sano et al. | 345/204 |
| 6,917,368 | B2 * | 7/2005 | Credelle et al. | 345/589 |
| 7,602,401 | B2 * | 10/2009 | Nishida et al. | 345/589 |
| 2003/0085906 | A1 * | 5/2003 | Elliott et al. | 345/613 |
| 2005/0062767 | A1 * | 3/2005 | Choe et al. | 345/694 |
| 2005/0179699 | A1 * | 8/2005 | Someya et al. | 345/611 |
| 2006/0066513 | A1 * | 3/2006 | Anai | 345/55 |
| 2006/0209054 | A1 * | 9/2006 | Someya et al. | 345/204 |

FOREIGN PATENT DOCUMENTS

| | | | |
|---|---|---|---|
| JP | 2003-259386 | | 9/2003 |
| JP | 2004264366 | A * | 9/2004 |
| WO | WO 2004075152 | A1 * | 9/2004 |

* cited by examiner

*Primary Examiner* — Liliana Cerullo

(74) *Attorney, Agent, or Firm* — Finnegan, Henderson, Farabow, Garrett & Dunner, L.L.P.

(57) ABSTRACT

An image display apparatus displaying an image on a panel having pixels each including a plurality of subpixels of different colors includes an interpolation operator interpolating consecutive sampling values of input color data supplied to drive the panel to correct phases of the input color data on the basis of positions of the subpixels in each pixel and output pieces of color data; a correction unit correcting signal levels of the output color data on the basis of associated predetermined gains; an angle information calculator calculating, for each pixel or subpixel, a direction of a viewer of the panel on the basis of a position of the viewer relative to the panel; and a gain setting unit setting, for the pieces of input color data, the gains so as to correct luminance levels of the subpixels, which change depending on the viewing direction, on the basis of the calculation result.

6 Claims, 10 Drawing Sheets

(PRIOR ART)

(PRIOR ART)

(PRIOR ART)

IMAGE DISPLAY APPARATUS AND METHOD FOR CORRECTING COLOR SIGNALS BASED ON A SUB-PIXEL LOCATION AND A POSITION OF A VIEWER

CROSS REFERENCES TO RELATED APPLICATIONS

The present invention contains subject matter related to Japanese Patent Application JP 2005-339578 filed in the Japanese Patent Office on Nov. 25, 2005, the entire contents of which are incorporated herein by reference.

BACKGROUND OF THE INVENTION

1. Field of the Invention

The present invention relates to image display apparatuses and methods, programs therefor, and recording media having recorded thereon the same, which can be applied to, for example, a monitor including a liquid crystal display (LCD) panel in which the coloring of an edge or the like is prevented by correcting the phases of pieces of color data on the basis of the arrangement (positions) of subpixels in each pixel, and the signal levels of the pieces of color data are corrected so as to correct the luminance levels of the subpixels, which change depending on the viewing direction, thereby preventing the coloring of the edge or the like by correcting the phases of the pieces of color data on the basis of the arrangement (positions) of the subpixels in each pixel while preventing a change in the luminance level of each subpixel depending on the viewing direction.

2. Description of the Related Art

In flat displays of the related art including LCDs and plasma display panels (PDPs), each pixel includes a plurality of subpixels of different colors, which are driven by associated pieces of color data to display a desired image.

That is, as shown in FIG. 8, a display device 1 of this type includes red subpixels 2R, green subpixels 2G, and blue subpixels 2B, which are sequentially and recursively arranged in the horizontal direction. Three consecutive subpixels 2R, 2G, and 2B form one pixel 3.

With regard to such a display device, a method has been proposed in, for example, Japanese Unexamined Patent Application Publication 2003-259386. The method involves correcting the phases of pieces of color data to be supplied to drive the associated subpixels on the basis of the arrangement (positions) of the subpixels, thereby increasing the apparent resolution.

In this type of display device, in the case where the subpixels are simply driven by the associated pieces of color data, when gray is displayed, an edge portion and a portion where the luminance gradually changes in gradation or the like seem to be colored.

That is, each piece of color data is a sampling value obtained at a timing for scanning the center of each pixel by raster scanning. Accordingly, as shown in FIG. 9A, in an edge portion in the case where gray is displayed, the luminance levels of three subpixels 2R, 2G, and 2B included in one pixel are reduced at the same time. Therefore, in this case, the color of a subpixel 2B1 which is the most adjacent to the edge and whose luminance level is high becomes striking in the edge portion, and hence, the edge portion seems to be colored with the color of the subpixel 2B1. In FIGS. 9A to 9D, the luminance levels of the subpixels 2R, 2G, and 2B are indicated in a height direction.

At the same time, as shown in FIG. 9B, in a portion where the luminance level gradually changes in the case where gray is displayed, the luminance levels of three subpixels 2R, 2G, and 2B included in one pixel are sequentially reduced step by step. Therefore, in this case, the color of the subpixel 2B on the side where the luminance level is gradually reduced becomes striking, and the portion where the luminance level gradually changes seems to be colored with the color of the subpixel 2B.

In order to solve these problems, one method involves correcting the phases of pieces of color data to be supplied to drive the subpixels 2R, 2G, and 2B on the basis of the arrangement (positions) of the subpixels 2R, 2G, and 2B in each pixel 3.

That is, as shown in FIGS. 9C and 9D in contrast to FIGS. 9A and 9B, in the case where the red, green, and blue subpixels 2R, 2G, and 2B are sequentially and recursively arranged, and the three consecutive red, green, and blue subpixels 2R, 2G, and 2B form one pixel 3, the subpixel 2G at the center of the pixel 3 is driven in a manner similar to the related art. With regard to the subpixel 2R prior to the central subpixel 2G, the phase of the associated piece of color data is corrected for the preceding portion, and the subpixel 2R is driven using the phase-corrected color data. In contrast, with regard to the subpixel 2B subsequent to the central subpixel 2G, the phase of the associated piece of color data is corrected for the portion subsequent to the subpixel 2G, and the subpixel 2B is driven using the phase-corrected color data.

Accordingly, in the edge portion, the luminance levels of the subsequent subpixel 2B and the preceding subpixel 2R subsequent to this subpixel 2B are sequentially reduced step by step, thereby preventing the coloring of the edge portion. In the portion where the luminance level gradually changes in gradation or the like, the luminance levels of the subpixels 2R, 2G, and 2B are sequentially reduced so as to correspond to the reduction in the luminance level, thereby preventing the coloring of this portion.

However, in this type of display device, as in a twisted nematic (TW) liquid crystal by way of example, luminance characteristics change depending on the viewing direction, and, as a result, the luminance level of each subpixel changes depending on the viewing direction. In the case where the luminance level of each subpixel changes depending on the viewing direction, when the phases of pieces of color data are corrected on the basis of the arrangement (positions) of the subpixels 2R, 2G, and 2B in each pixel 3 in the above-described manner, the color changes depending on the viewing direction in a repeated-pattern portion where the spatial frequency is high.

That is, as shown in FIGS. 10A and 10B in contrast to FIGS. 9A to 9D, in the case where the luminance levels of the subpixels 2R, 2G, and 2B included in each pixel 3 are maintained at the same level, and the luminance level changes in units of pixels, the luminance level ratio among the subpixels 2R, 2G, and 2B in each pixel 3 does not change between the case shown in FIG. 10A when viewed from the front and the case shown in FIG. 10B when viewed diagonally. In this case, the color does not change when the viewing direction changes.

However, as shown in FIGS. 10C and 10D in contrast to FIGS. 10A and 10B, when the phases of pieces of color data are corrected on the basis of the arrangement (positions) of the subpixels 2R, 2G, and 2B, the luminance level ratio among the subpixels 2R, 2G, and 2B in each pixel 3 changes between the case when viewed from the front and the case when viewed diagonally. Therefore, in this case, the color changes depending on the viewing direction. When the driving of the subpixels 2R, 2G, and 2B is adjusted so as to achieve the color balance when viewed from the front, the color balance when viewed diagonally is disrupted.

In this type of display device, the luminance level of each subpixel may change depending on the viewing direction due to the effects of the refractive index and the transmittance of a panel surface material, such as glass, provided on the surface of a display screen.

SUMMARY OF THE INVENTION

It is desirable to provide an image display apparatus and method, a program therefor, and a recording medium having recorded thereon the same for preventing the coloring of an edge or the like by correcting the phases of pieces of color data on the basis of the arrangement (positions) of subpixels in each pixel while preventing a change in the luminance level of each subpixel depending on the viewing direction.

According to a first embodiment of the present invention, there is provided an image display apparatus for displaying an image on an image display panel having a plurality of pixels each including a plurality of subpixels of different colors. The image display apparatus includes the following elements: an interpolation operator operable to interpolate consecutive sampling values of pieces of input color data supplied to drive the image display panel to thereby correct phases of the pieces of input color data on the basis of positions of the subpixels in each pixel and output pieces of output color data; a correction unit operable to correct signal levels of the pieces of output color data on the basis of associated predetermined gains; an angle information calculator operable to calculate, for each pixel or for each subpixel, a direction of a viewer of the image display panel on the basis of a position of the viewer relative to the image display panel; and a gain setting unit operable to set, for the pieces of input color data, the associated gains used in processing performed by the correction unit so as to correct luminance levels of the associated subpixels, which change depending on a viewing direction, on the basis of a calculation result obtained by the angle information calculator.

According to a second embodiment of the present invention, there is provided an image display method of displaying an image on an image display panel having a plurality of pixels each including a plurality of subpixels of different colors. The image display method includes the steps of interpolating consecutive sampling values of pieces of input color data supplied to drive the image display panel to thereby correct phases of the pieces of input color data on the basis of positions of the subpixels in each pixel and outputting pieces of output color data; correcting signal levels of the pieces of output color data on the basis of associated predetermined gains; calculating, for each pixel or for each subpixel, a direction of a viewer of the image display panel on the basis of a position of the viewer relative to the image display panel; and setting, for the pieces of input color data, the associated gains so as to correct luminance levels of the associated subpixels, which change depending on a viewing direction, on the basis of a calculation result.

According to a third embodiment of the present invention, there is provided a program for allowing a processor to execute an image display method of displaying an image on an image display panel having a plurality of pixels each including a plurality of subpixels of different colors. The image display method includes the steps of interpolating consecutive sampling values of pieces of input color data supplied to drive the image display panel to thereby correct phases of the pieces of input color data on the basis of positions of the subpixels in each pixel and outputting pieces of output color data; correcting signal levels of the pieces of output color data on the basis of associated predetermined gains; calculating, for each pixel or for each subpixel, a direction of a viewer of the image display panel on the basis of a position of the viewer relative to the image display panel; and setting, for the pieces of input color data, the associated gains so as to correct luminance levels of the associated subpixels, which change depending on a viewing direction, on the basis of a calculation result.

According to a fourth embodiment of the present invention, there is provided a recording medium having recorded thereon a program for allowing a processor to execute an image display method of displaying an image on an image display panel having a plurality of pixels each including a plurality of subpixels of different colors. The image display method includes the steps of interpolating consecutive sampling values of pieces of input color data supplied to drive the image display panel to thereby correct phases of the pieces of input color data on the basis of positions of the subpixels in each pixel and outputting pieces of output color data; correcting signal levels of the pieces of output color data on the basis of associated predetermined gains; calculating, for each pixel or for each subpixel, a direction of a viewer of the image display panel on the basis of a position of the viewer relative to the image display panel; and setting, for the pieces of input color data, the associated gains so as to correct luminance levels of the associated subpixels, which change depending on a viewing direction, on the basis of a calculation result.

According to the structure of the first embodiment of the present invention, there is provided an image display apparatus for displaying an image on an image display panel having a plurality of pixels each including a plurality of subpixels of different colors. The image display apparatus includes the following elements: an interpolation operator operable to interpolate consecutive sampling values of pieces of input color data supplied to drive the image display panel to thereby correct phases of the pieces of input color data on the basis of positions of the subpixels in each pixel and output pieces of output color data; a correction unit operable to correct signal levels of the pieces of output color data on the basis of associated predetermined gains; an angle information calculator operable to calculate, for each pixel or for each subpixel, a direction of a viewer of the image display panel on the basis of a position of the viewer relative to the image display panel; and a gain setting unit operable to set, for the pieces of input color data, the associated gains used in processing performed by the correction unit so as to correct luminance levels of the associated subpixels, which change depending on a viewing direction, on the basis of a calculation result obtained by the angle information calculator. In this manner, a change in the luminance level of each subpixel depending on the viewing direction can be prevented by setting the gain by the gain setting unit. Accordingly, the phases of the pieces of color data are corrected on the basis of the arrangement (positions) of the subpixels in each pixel to prevent the coloring of an edge or the like, while preventing a change in the luminance level of each subpixel depending on the viewing direction.

According to the structures of the second, third, and fourth embodiments of the present invention, there are provided an image display method, a program therefor, and a recording medium having recorded thereon the same in which the phases of the pieces of color data are corrected on the basis of the arrangement (positions) of the subpixels in each pixel, thereby preventing the coloring of an edge or the like while preventing a change in the luminance level of each subpixel depending on the viewing direction.

According to the embodiments of the present invention, the phases of pieces of color data are corrected on the basis of the arrangement (positions) of subpixels in each pixel to prevent the coloring of an edge or the like, while preventing a change in the luminance level of each subpixel depending on the viewing direction.

DESCRIPTION OF THE PREFERRED EMBODIMENTS

Embodiments of the present invention will be described with reference to the accompanying drawings.

First Embodiment

(1) Structure

Figure 2:
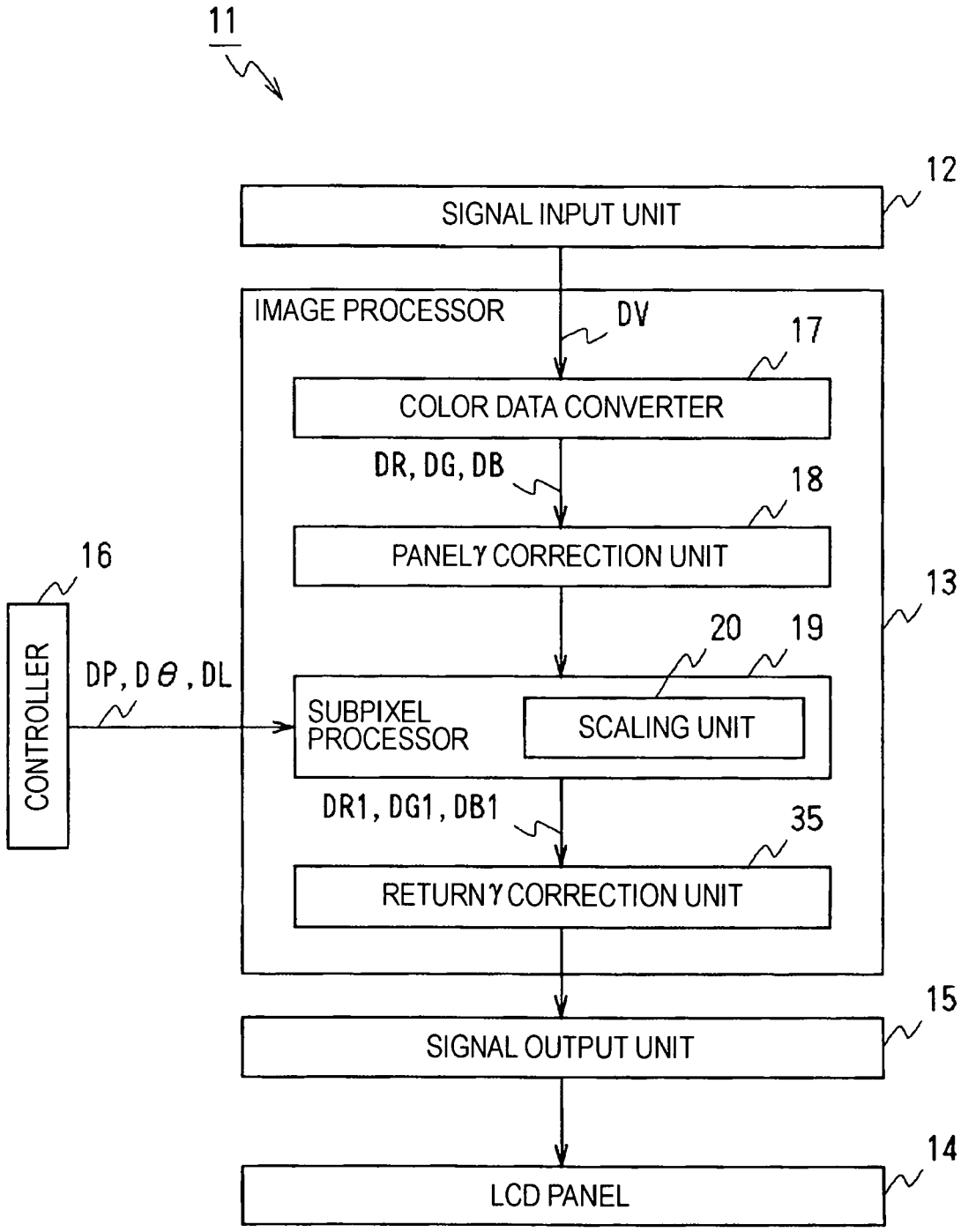
FIG. 2 is a block diagram showing the monitor according to the first embodiment of the present invention.

FIG. 2 is a block diagram showing a monitor according to a first embodiment of the present invention. In a monitor 11, a controller 16 is a processor for controlling the operation of each element of the monitor 11 in response to user operations on an operation unit by executing a program recorded on a memory (not shown). Under the control of the controller 16, a signal input unit 12 receives video data DV including a luminance signal and a color-difference signal from various sources including, for example, a tuner, a digital versatile disk (DVD), and a player.

Figure 8:
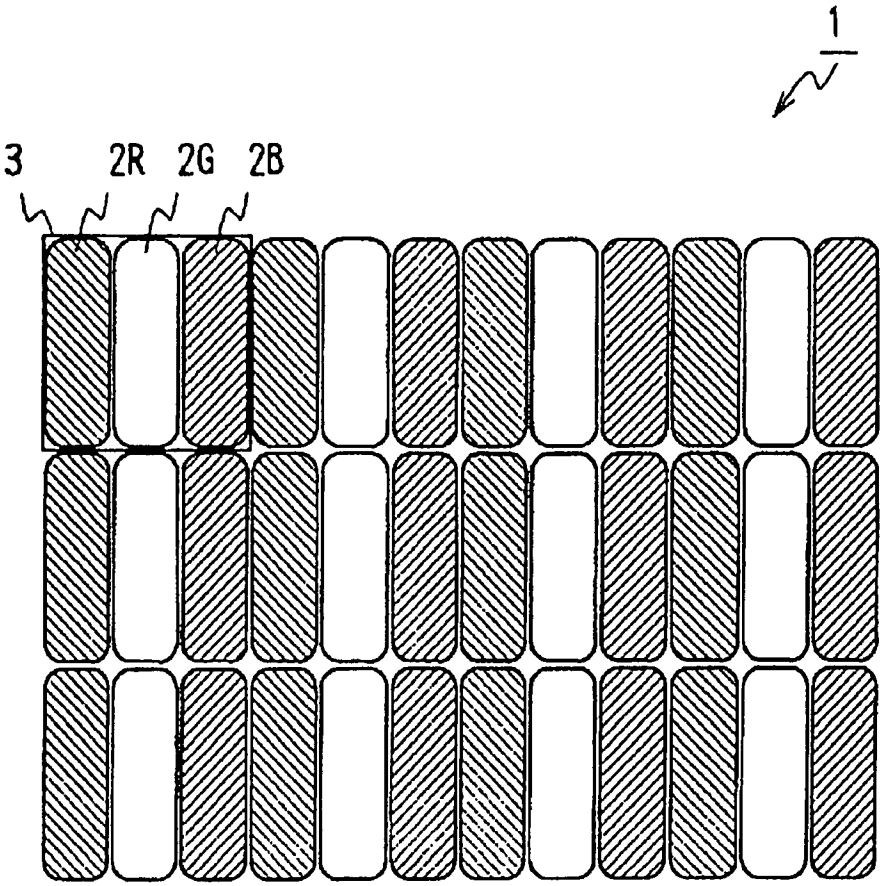
FIG. 8 is a plan view showing the structure of each pixel in a display device.
Figure 9A:
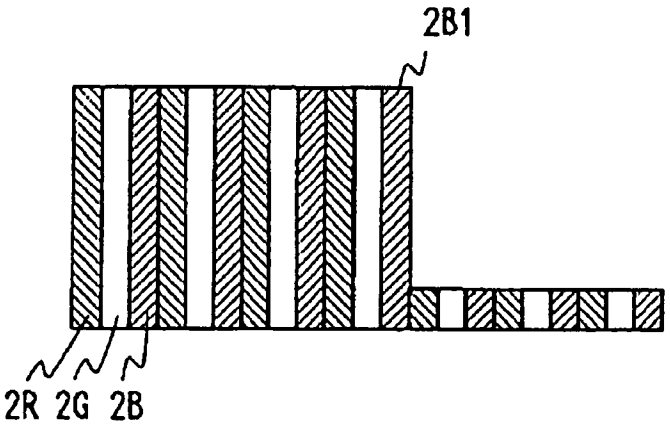
FIGS. 9A to 9D are diagrams schematically illustrating the coloring.
Figure 9B:
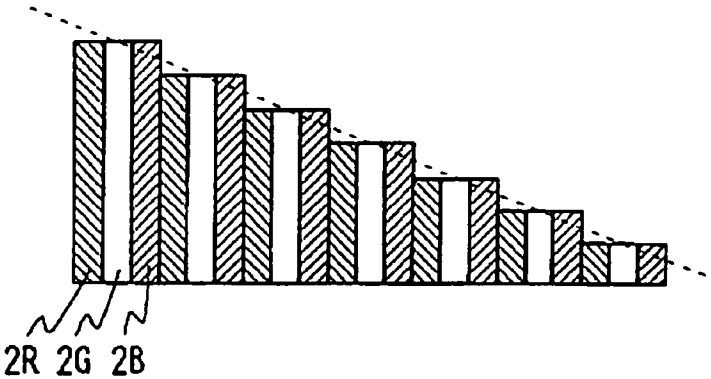
Figure 9C:
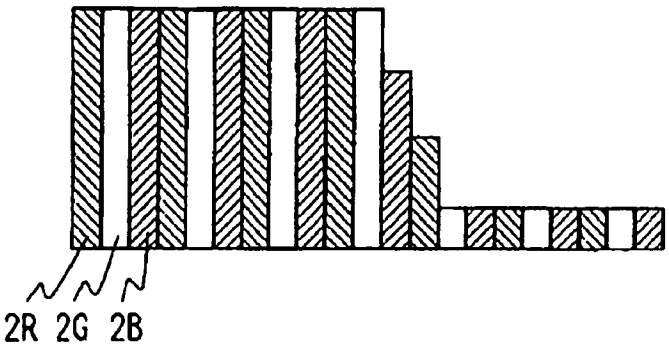
Figure 9D:
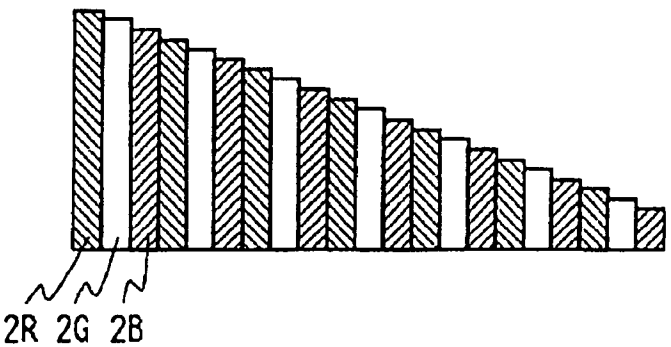
Figure 10A:
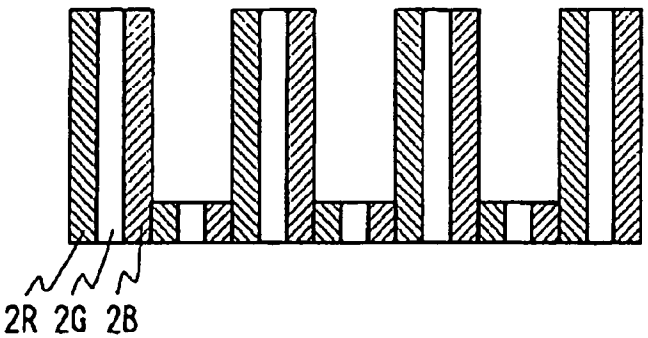
FIGS. 10A to 10D are diagrams schematically illustrating a change in color depending on the viewing direction.
Figure 10B:
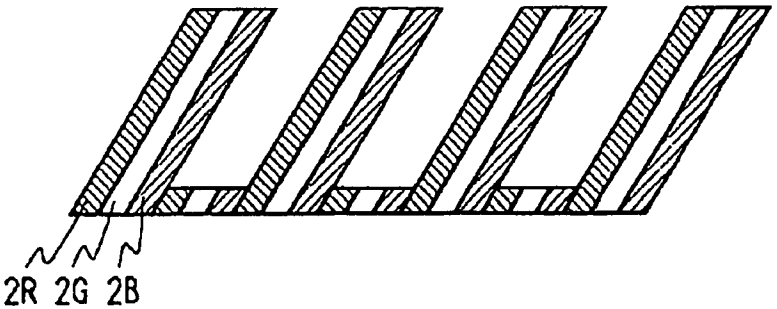
Figure 10C:
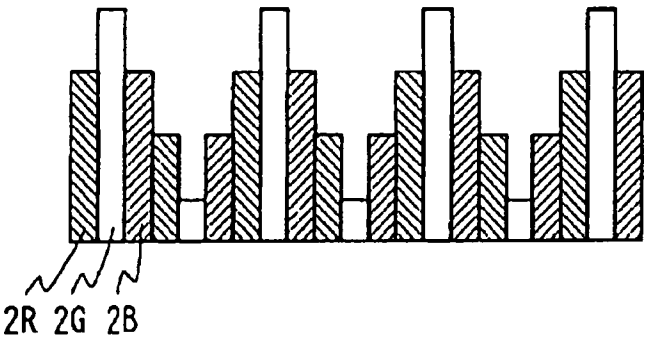
Figure 10D:
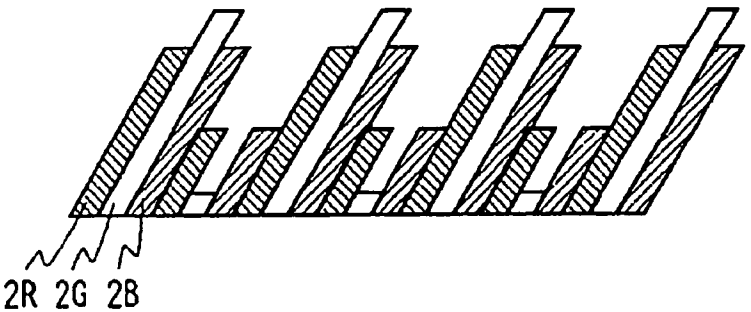

Similarly, under the control of the controller 16, an image processor 13 processes the video data DV input from the signal input unit 12 and outputs the processed data. An LCD panel 14 is an image display panel having pixels each including subpixels arranged in a so-called in-line format, as has been described with reference to FIG. 8. A signal output unit 15 drives the LCD panel 14 using output data of the image processor 13. Accordingly, the monitor 11 displays various images on the LCD panel 14 on the basis of the video data DV output from the sources.

The image processor 13 processes the video data DV input from the signal input unit 12 so as to be suitable for driving the signal output unit 15 and outputs the processed video data. In this processing, the image processor 13 corrects the phases of pieces of color data for driving the associated subpixels on the basis of the arrangement (positions) of the subpixels in each pixel of the LCD panel 14, thereby preventing the coloring of an edge or the like.

In the image processor 13, a color data converter 17 converts the video data DV including the luminance signal and the color-difference signal into pieces of color data corresponding to the associated subpixels of the LCD panel 14 by performing matrix calculations. In the first embodiment, as has been described with reference to FIG. 8, the LCD panel 14 includes the red, green, and blue subpixels 2R, 2G, and 2B, which are sequentially and recursively arranged in a horizontal direction. Accordingly, the color data converter 17 converts the video data DV including the luminance signal and the color-difference signal into red, green, and blue color data DR, DG, and DB and outputs the color data DR, DG, and DB.

In the image processor 13, the pieces of color data DR, DG, and DB are input via a panel γ correction unit 18 to a subpixel processor 19, which in turn corrects the phases of the pieces of color data DR, DG, and DB on the basis of the arrangement (positions) of the subpixels in the LCD panel 14, thereby preventing the coloring of an edge or the like.

Figure 3:
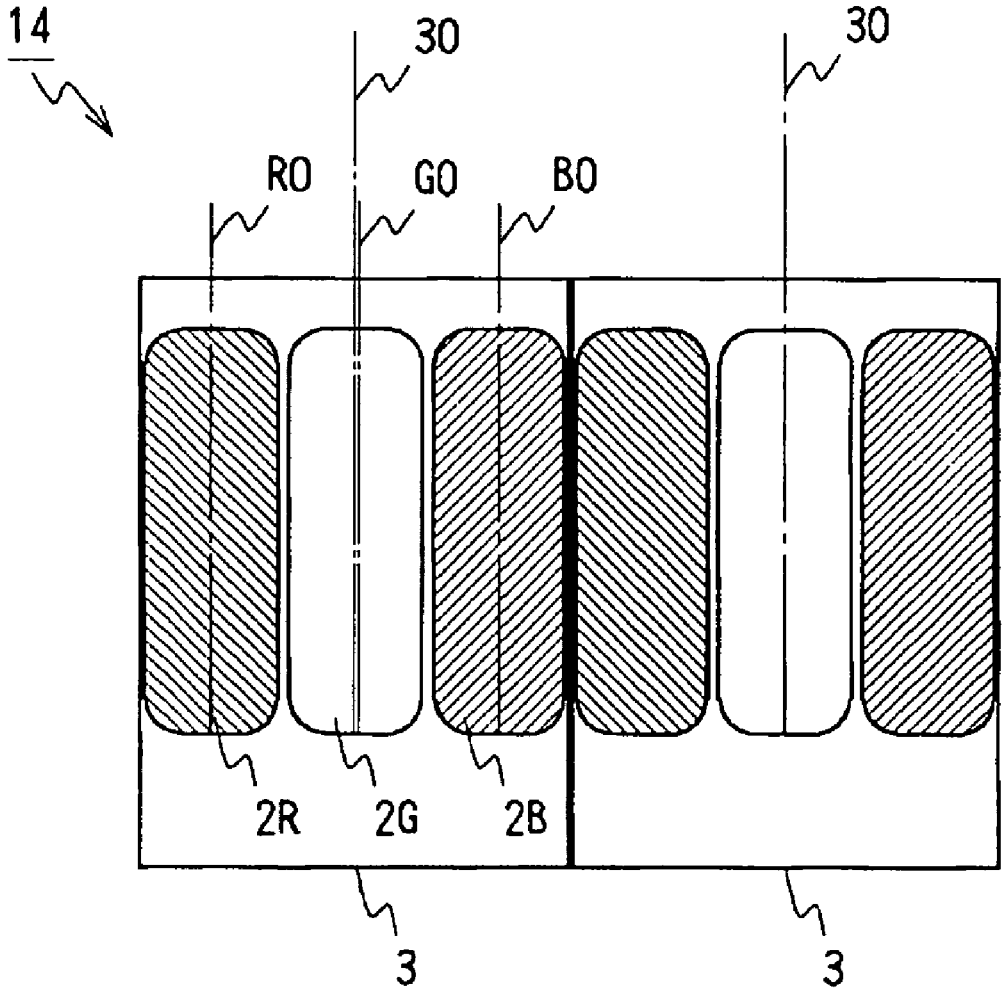
FIG. 3 is a diagram schematically illustrating phase correction in the monitor shown in FIG. 2.

The pieces of color data DR, DG, and DB are sampling values obtained at a timing for scanning the center of each pixel by raster scanning. In contrast, as shown in FIG. 3, the subpixels 2R, 2G, and 2B driven by the associated pieces of color data DR, DG, and DB are arranged at positions shifted from the center 30 of each pixel 3. Due to the differences between the sampling timings of the color data DR, DG, and DB and the actual arrangement (positions) of the subpixels 2R, 2G, and 2B, as has been described with reference to FIGS. 9A to 9D, an edge portion or the like seems to be colored. Thus, a scaling unit 20 in the subpixel processor 19 corrects the phases of the pieces of color data DR, DG, and DB so as to achieve sampling values obtained at timings for scanning the center RO, GO, and BO of the associated subpixels 2R, 2G, and 2B.

More specifically, for example, when the subpixels 2R, 2G, and 2B are of the same size and are arranged at an equal pitch, the center GO of the central green subpixel 2G coincides with the center 30 of the pixel 3. In this case, the associated color data DG is output without being phase-corrected, thereby outputting the green color data DG in terms of the sampling value sampled at a timing for scanning the center GO of the green subpixel 2G.

In contrast, the red subpixel 2R prior to the green subpixel 2G is arranged at a position prior to the green subpixel 2G by a third of a repeating cycle of the pixel 3. By correcting the phase of the red color data DR so that the sampling value sampled at a timing earlier by a third of the repeating cycle is output, the red color data DR can be output in terms of the sampling value sampled at a timing for scanning the center RO of the red subpixel 2R.

In contrast, the blue subpixel 2B subsequent to the green subpixel 2G is arranged at a position subsequent to the green subpixel 2G by a third of the repeating cycle of the pixel 3. By correcting the phase of the blue color data DB so that the sampling value sampled at a timing later by a third of the repeating cycle is output, the blue color data DB can be output in terms of the sampling value sampled at a timing for scanning the center BO of the blue subpixel 2B.

On the basis of this correction principle, the scaling unit 20 corrects the phases of the pieces of color data DR, DG, and DB by interpolating the successive sampling values of the color data DR, DG, and DB.

The interpolation of the successive sampling values may be performed by linear interpolation, cubic interpolation, Sinc function interpolation, or the like. Among these schemes, the linear interpolation is the simplest of all and involves the least number of calculations. However, the linear interpolation is disadvantageous in that the frequency characteristics deteriorate greatly, and hence an image tends to be more out of focus. In contrast, the cubic interpolation can reduce the amount of out-of-focus. However, the cubic interpolation is disadvantageous in that ringing is likely to occur in an edge portion, and such ringing may cause a striking change in color. The interpolation using a Sinc function is advantageous in that it can reduce errors and theoretically can obtain a correct interpolated value by setting the number of convolutions to infinite. Actually, however, it is difficult to set the number of convolutions to infinite. Therefore, in the first embodiment, the number of convolutions is limited using a window function.

In this way, in the first embodiment, the scaling unit 20 performs the interpolation by performing the Sinc function interpolation using the Lanczos function as the window function:

$$Sinc(x) = \begin{cases} 1 \ldots & (x = 0) \\ \dfrac{\sin(2\pi Cx)}{2\pi Cx} \ldots & (x > 0) \end{cases} \quad (1)$$

$$Lanczos(x) = \begin{cases} 1 \ldots & (x = 0) \\ \dfrac{\sin(\pi x/N)}{\pi x/N} \ldots & (0 < x < N) \\ 0 \ldots & (x \geq N) \end{cases} \quad (2)$$

where N is the number of lobes, and Cx is a cutoff frequency. By adjusting these values, interpolation characteristics and the number of taps of interpolation coefficients are determined. The coefficients for use in the interpolation can be obtained by substituting the phase regarding the position of each of the subpixels 2R, 2G, and 2B for x and computing the product of the Sinc function and the Lanczos function. The scaling unit 20 performs filtering with the coefficients to interpolate the color data DR, DG, and DB. Accordingly, as has been described above, when the subpixels 2R, 2G, and 2B are of the same size and are arranged at an equal pitch, x=0 for the green color data DG, x=−120 degrees for the red color data DR, and x=120 degrees for the blue color data DB.

In the case where the phase of the green color data DG is 0 and the phases of the red and blue color data DR and DB are corrected relative to the green color data DG, the green color data DG is output without being interpolated. Interpolation is performed only on the red and blue color data DR and DB, thereby correcting the phases of the color data DR, DG, and DB. Accordingly, the entire structure can be simplified. In this case, however, because only the red and blue color data DR and DB are interpolated, the resolutions of the red and blue color data DR and DB are reduced compared with that of the green color data DG. In order to prevent such relative reductions in resolution, the phase of the green color data may be set to 30 degrees or 60 degrees, for example, and, on the basis of this phase of the green color data, the phases of the red and blue color data may be set. Thereafter, the pieces of color data DG, DR, and DB may be interpolated.

Figure 4:
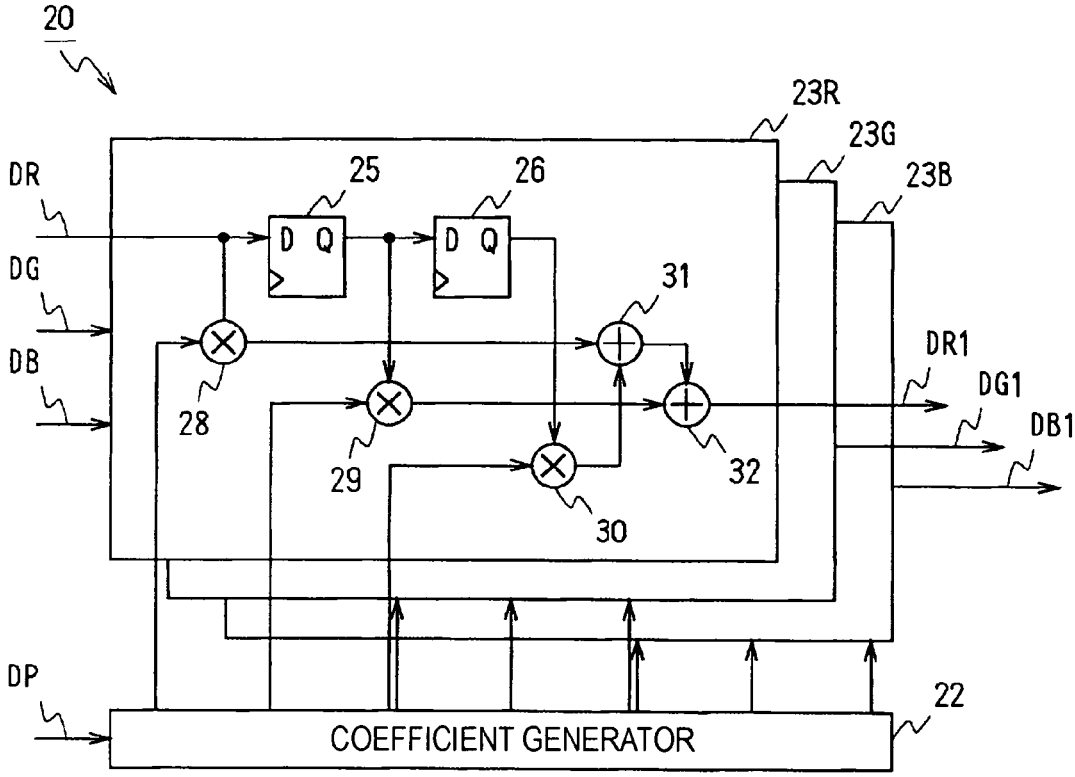
FIG. 4 is a block diagram showing a scaling unit in the subpixel processor shown in FIG. 1.

FIG. 4 is a block diagram showing the structure of the scaling unit 20 in the case where the number of taps of interpolation coefficients is three. In the scaling unit 20, a coefficient generator 22 is a read only memory holding the coefficients described using equations (1) and (2) for the associated phases. On the basis of phase data DP input depending on the setting of the monitor 11, the coefficient generator 22 outputs the coefficients to color data correction units 23R, 23G, and 23B. By switching the phase data DP, the scaling unit 20 can variously adjust the phases for correcting the color data DG, DR, and DB. The coefficients held in the coefficient generator 22 are those multiplied by the gain of the interpolation. Therefore, the gain control can be performed easily in the first embodiment.

The color data correction units 23R, 23G, and 23B have the same structure except that different coefficients are input thereto from the coefficient generator 22. Delay units 25 and 26 including latch circuits sequentially delay the color data DR, DG, and DB by one clock cycle of the color data DR, DG, and DB to generate three consecutive sampling values of each of the color data DR, DG, and DB.

Multipliers 28, 29, and 30 multiply the three consecutive sampling values of each of the color data DR, DG, and DB by the associated coefficients output from the coefficient generator 22. Adders 31 and 32 add the products of the multipliers 28 to 30 and output the sums. In this manner, the color data correction units 23R, 23G, and 23B perform interpolation using a three-tap interpolation filter to correct the phases of the color data DR, DG, and DB and output the corrected color data DR, DG, and DB.

When practically sufficient characteristics can be ensured, a technique such as a linear interpolation technique may be employed. In this case, for example, the following equations are calculated to obtain, from sampling values Ri, Gi, and Bi of the color data DR, DG, and DB, sampling values SRi, SGi, and SBi of phase-corrected color data DR1, DG1, and DB1:

$$SR_i = \tfrac{1}{3} \times R_{i-1} + \tfrac{2}{3} \times R_i$$

$$SG_i = G_i$$

$$SB_i = \tfrac{2}{3} \times B_i + \tfrac{1}{3} \times B_{i+1} \quad (3)$$

In the case where the coloring of an edge or the like is prevented by correcting the phases of the color data DR, DG, and DB, it is necessary to take into consideration the influence of gamma in a series of transmission lines reaching the eyes of a person.

Figure 5:
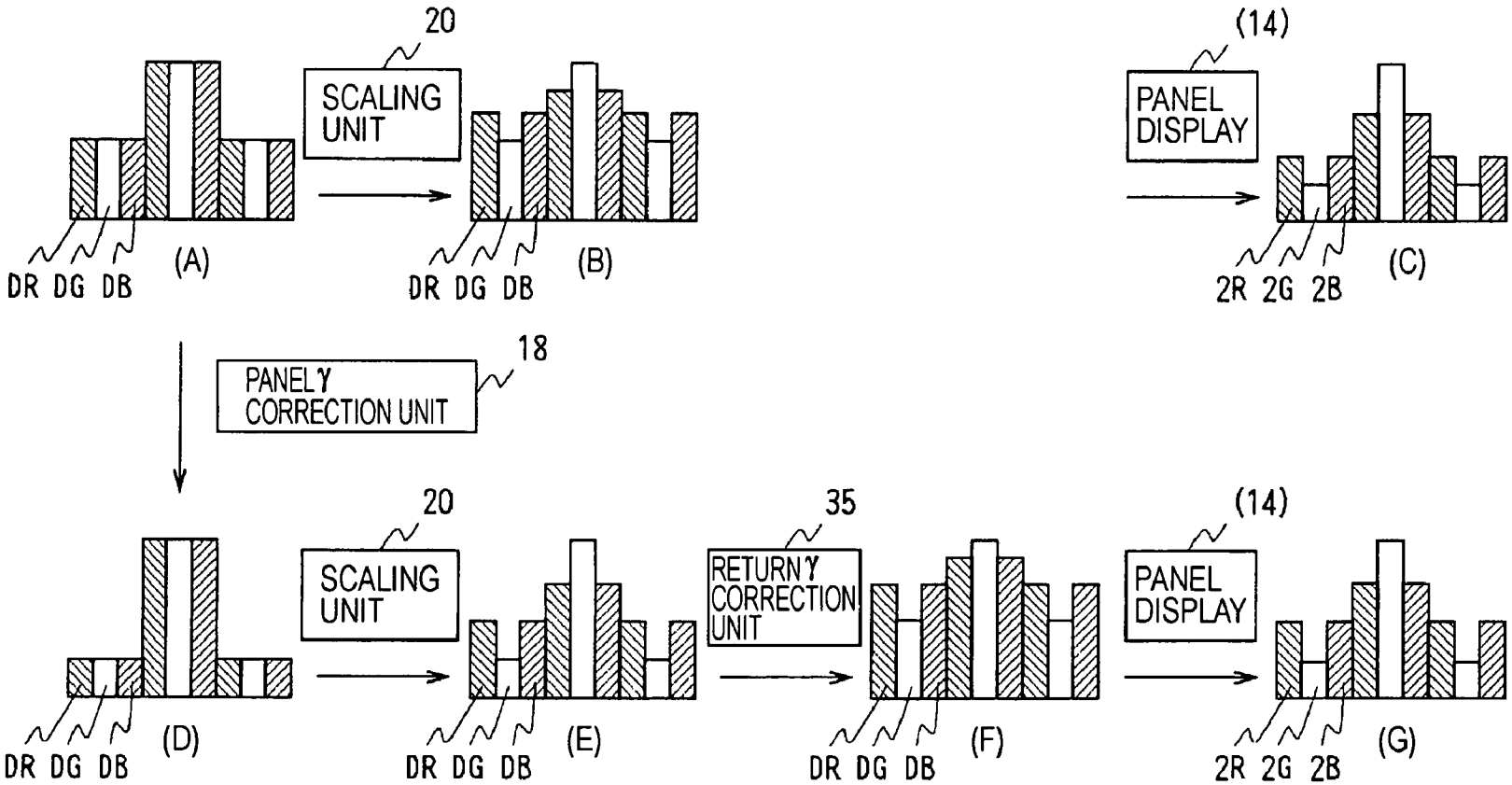
FIG. 5 includes diagrams schematically illustrating gamma correction performed by the subpixel processor shown in FIG. 1.

That is, as shown in portions (A) and (B) of FIG. 5, when the phases of the color data DR, DG, and DB are simply corrected (portion (A) of FIG. 5) to correct the luminance levels of the color data DR, DG, and DB (portion (B) of FIG. 5), because of the gamma of the LCD panel 14 and the gamma of the human visibility characteristics, as shown in portion (C) of FIG. 5, the luminance level balance among the subpixels 2R, 2G, and 2B changes. As a result, a portion such as a black-and-white repeated-fine-pattern portion where the spatial frequency is high is observed to be colored green.

Therefore, in the image processor 13 of the first embodiment, the pieces of color data DR, DG, and DB are input via the panel γ correction unit 18 to the subpixel processor 19, and the pieces of color data DR1, DG1, and DB1 output from the subpixel processor 19 are output via a return γ correction unit 35 to the signal output unit 15 (FIG. 2).

The panel γ correction unit 18 corrects the shades of the color data DR, DG, and DB on the basis of the characteristics of the product of the gamma of the LCD panel 14 and the gamma of the human visibility characteristics and outputs the shade-corrected color data. As a result, the shades of the color data DR, DG, and DB are corrected to those actually perceived by a person.

On the basis of the characteristics opposite to those used in the panel γ correction unit 18, the return γ correction unit 35 corrects the shades of the color data DR1, DG1, and DB1 output from the subpixel processor 19, thereby outputting the color data DR1, DG1, and DB1 having the same shades as those of the original color data DR, DG, and DB. The shade correction performed by the panel γ correction unit 18 and the return γ correction unit 35 is performed using, for example, a look-up table.

In the first embodiment, as shown in portions (A) and (D) to (G) of FIG. 5 in contrast to portions (A) to (C) of FIG. 5, the color balance is prevented from changing in the portion where the spatial frequency is high.

Even when the phases of the pieces of color data are corrected on the basis of the arrangement (positions) of the subpixels in each pixel to prevent the coloring of an edge or the like, as has been described with reference to FIGS. 10A to 10D, because of various reasons, the luminance level of each subpixel changes depending on the viewing direction. As a result, the color changes. Therefore, the subpixel processor 19 prevents a change in the luminance level of each subpixel depending on the viewing direction by controlling the gain of each piece of color data.

Figure 1:
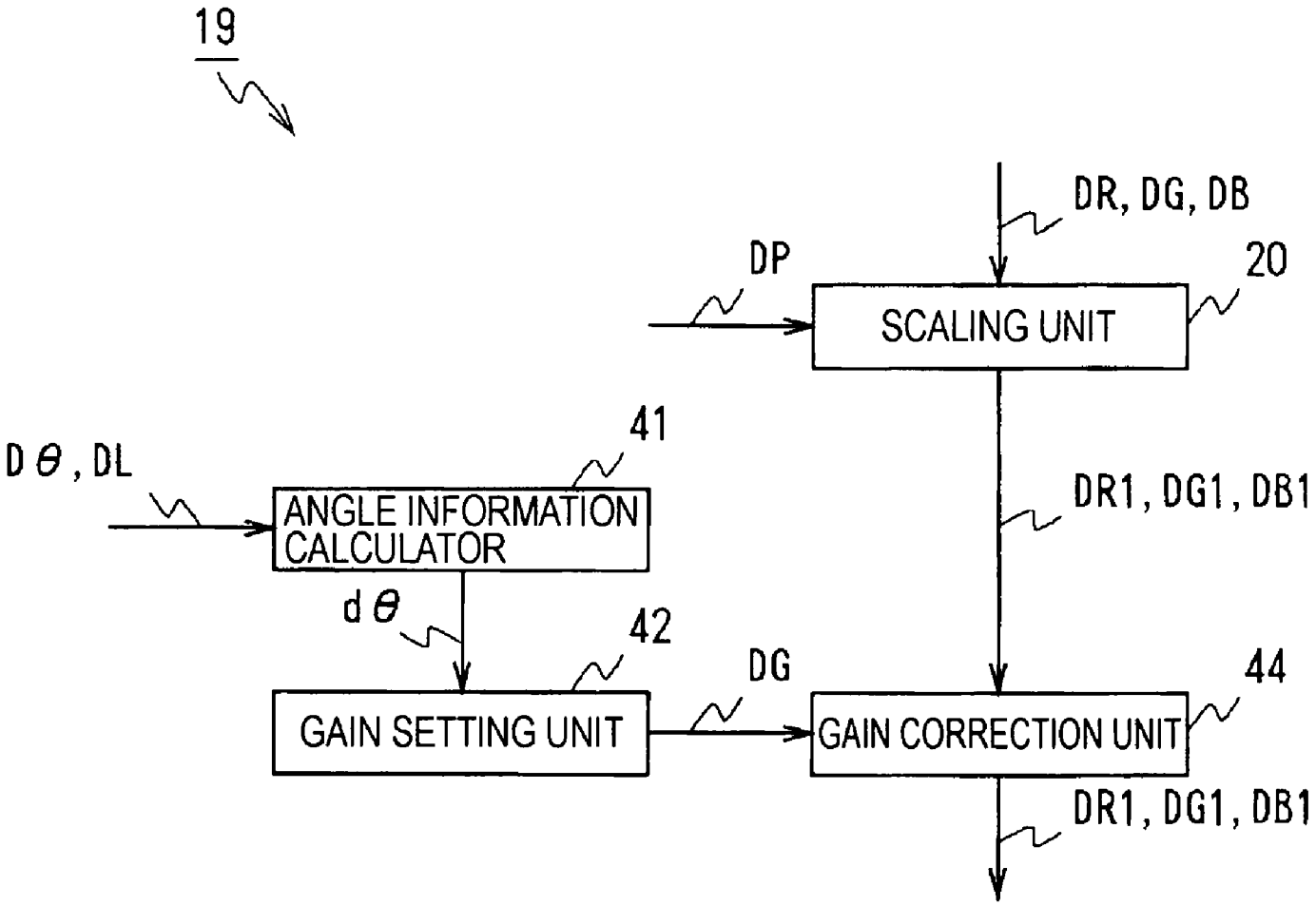
FIG. 1 is a block diagram showing a subpixel processor of a monitor according to a first embodiment of the present invention.
Figure 6:
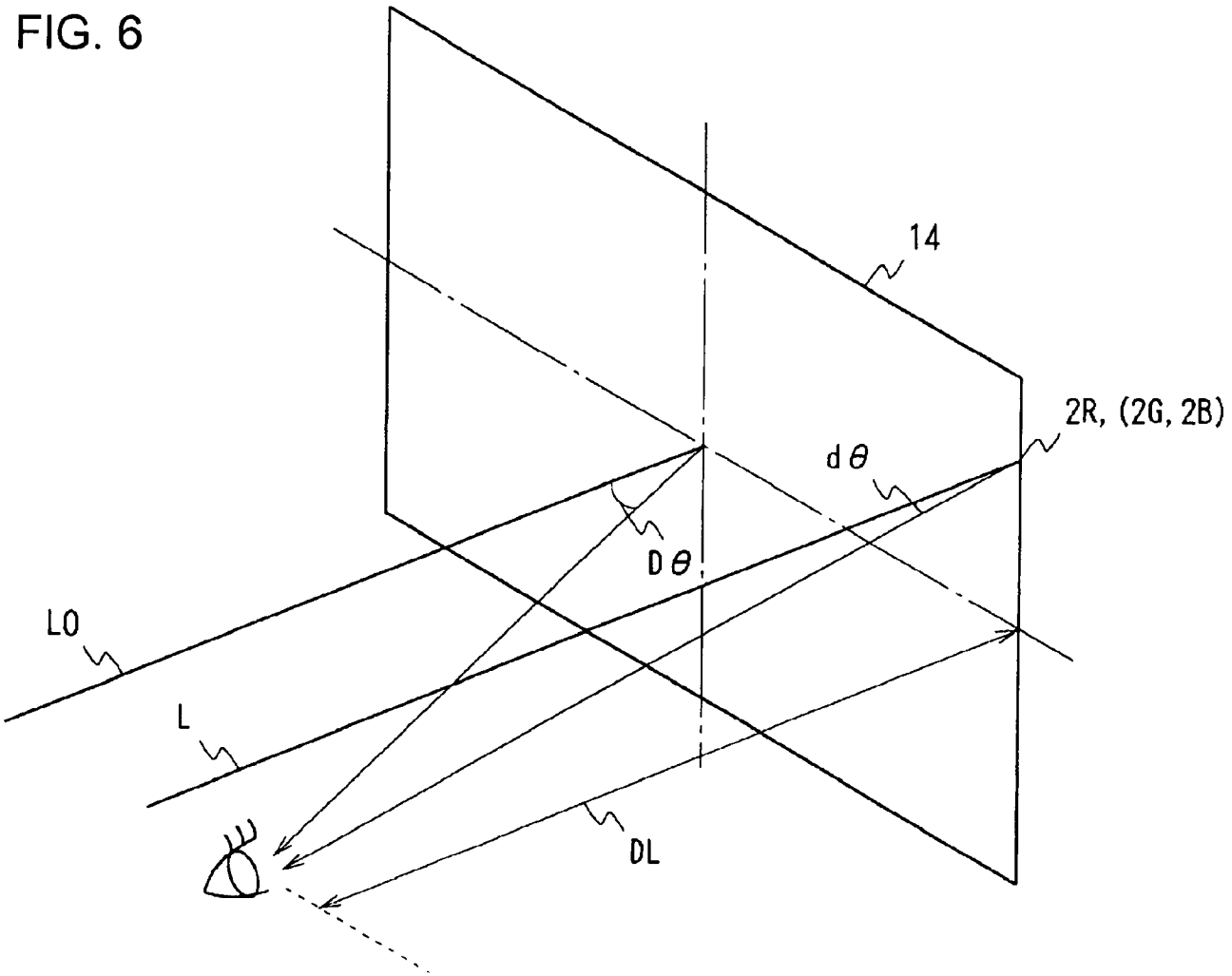
FIG. 6 is a diagram schematically showing the relationship between the position of a viewer of the monitor shown in FIG. 2 and the viewing direction.

That is, FIG. 1 is a block diagram showing the structure of the subpixel processor 19. In the subpixel processor 19, an angle information calculator 41 calculates, as shown in FIG. 6, a viewer direction dθ for each subpixel to be processed by the scaling unit 20 on the basis of pieces of viewer's position information Dθ and DL supplied from the controller 16.

In response to a user operation using a remote commander (not shown), the controller 16 inputs, instead of the video data from the signal input unit 12, video data of a predetermined menu screen to the image processor 13. Accordingly, the menu screen is displayed on the LCD panel 14. When the user selects a certain item on the menu screen, a menu screen for performing various settings is displayed on the monitor. By selecting a certain item on the menu screen for performing various settings, the input of a viewing position is accepted.

The viewing position for viewing a monitor at home is generally determined. To accept the input of such a viewing position, for example, the position that is in front of the center of the LCD panel 14 and that is at a distance determined on the basis of the size of the LCD panel 14 may be set as a standard viewing position, and the viewing position may be accepted by how much the viewing position is shifted from the standard viewing position. Alternatively, instead of these preliminary settings, the viewing position may be detected by detecting the position of the viewer by processing an image serving as the imaging result obtained by an imager. The viewing position may be detected by detecting the position of the viewer using infrared sensors or the like. To detect the position of the viewer by processing an image serving as the imaging result, an image of a scene where the viewer is expected to exit is captured, the center of which is the front of the display screen. By processing this image, the face of the viewer may be detected from the imaging result, and, on the basis of the position and the size of the detected face, the viewer direction and the distance to the viewer may be detected. In contrast, in the case of using sensors, a plurality of sensors for receiving remote control signals from the remote commander may be arranged at a plurality of positions, such as the top, bottom, left, and right portions of the display screen. These sensors detect the strengths of the remote control signals output from the remote commander, and the viewer direction and the distance to the viewer can be detected with a triangulation technique.

The controller 16 detects the viewing position of the viewer on the basis of the angle Dθ in the horizontal and vertical directions with reference to the center of the display screen of the LCD panel 14 and the direction of a perpendicular LO of the display screen and the distance DL from the display screen. The controller 16 informs the angle information calculator 41 of the detection result including the viewer's position information Dθ and DL.

On the basis of the viewer's position information Dθ and DL, the angle information calculator 41 calculates, for each subpixel or for each pixel, the viewer direction dθ from the angle in the horizontal and vertical directions relative to the perpendicular L of the display screen of the LCD panel 14.

A gain setting unit 42 includes a look-up table recording, for each piece of color data, gain data DG for correcting the gain of each piece of color data in each direction that may be calculated by the angle information calculator 41. On the basis of the viewer direction dθ informed by the angle information calculator 41, the gain setting unit 42 outputs the associated gain data DG for each piece of color data. The gain data DG recorded in the gain setting unit 42 is, with reference to the direction of the perpendicular of the display screen of the LCD panel 14, gain information for correcting the luminance level of each subpixel, which decreases depending on the viewing direction, which is shifted from the direction of the perpendicular in the horizontal and vertical directions. The gain data DG is obtained by measuring the actual values of the standard characteristics of the LCD panel 14 and are recorded in advance at a factory fabricating the monitor 11.

A gain correction unit 44 sets the gain of an amplifier circuit on the basis of the gain data DG output from the gain setting unit 42. The gain correction unit 44 amplifies the pieces of color data DR, DG, and DB output from the scaling unit 20 and outputs the amplified data, thereby correcting and outputting the signal levels of the color data DR, DG, and DB according to the viewer direction.

In the processing involving the setting of the gain of each subpixel according to the viewer direction dθ and the correction of the signal levels of the color data DR, DG, and DB, data may be discretely recorded and held in the look-up table of the gain setting unit 42. By interpolating the discrete data, the final gain may be calculated. In this manner, the structure of the look-up table can be simplified.

(2) Operation

With the above-described structure of the monitor 11 (FIG. 2), video data DV including a luminance signal and a color-difference signal is input from the signal input unit 12 to the color data converter 17 in the image processor 13. The color data converter 17 converts the video data DV into color data DR, DG, and DB corresponding to the associated subpixels of the LCD panel 14. The signal output unit 15 supplies the pieces of color data to drive the associated subpixels of the LCD panel 14. Accordingly, the monitor 11 displays an image based on the video data DV on the LCD panel 14.

However, the pieces of color data DR, DG, and DB generated from the video data DV in this manner (FIGS. 9A to 9D) are the sampling values obtained by sampling at a timing for scanning the center of each pixel 3 (FIG. 3). When the pieces of color data DR, DG, and DB are supplied without being processed to drive the LCD panel 14, an edge portion and a portion where the luminance level gradually changes become colored.

Therefore, in the monitor 11, the phases of the pieces of color data DR, DG, and DB generated from the video data DV are corrected by the scaling unit 20 in the subpixel processor 19 (FIG. 4) on the basis of the arrangement (positions) of the subpixels in each pixel to generate pieces of color data DR1, DG1, and DB1. Using the color data DR1, DG1, and DB1, the LCD panel 14 is driven. This enables the monitor 11 to prevent the coloring of an edge portion and a portion where the luminance level gradually changes.

However, when the coloring is prevented in this manner, as has been described with reference to FIGS. 10A to 10D, the luminance level of each subpixel changes depending on the viewing direction due to a change in luminance caused by the visibility characteristics of the LCD panel 14 under various conditions. As a result, the color changes in a repeated-pattern area where the spatial frequency is high depending on the viewing direction.

Therefore, in the monitor 11, the controller 16 for controlling the overall operation detects the position of the viewer. On the basis of the position of the viewer, the angle information calculator 41 calculates the direction of the viewer viewing each subpixel. On the basis of the calculation results, the gain setting unit 42 calculates the gain of each piece of color data DR1, DG1, and DB1 so as to compensate for a change in the luminance level of each subpixel depending on the viewing direction. On the basis of the calculated gains, the gain correction unit 44 corrects the signal levels of the color data DR1, DG1, and DB1.

In this manner, according to the first embodiment, the coloring of an edge or the like is prevented by correcting the phases of the pieces of color data on the basis of the arrangement (positions) of the subpixels in each pixel, and a change in the luminance level of each subpixel depending on the viewing direction is prevented. This prevents a change in color caused by a change in the luminance level.

Even when the coloring as well as a change in color depending on the viewing direction are prevented in this manner, in the end, such coloring and a change in color depending on the viewing direction are perceived by a person. Therefore, it is necessary to take into consideration the human vision characteristics when performing a series of steps of processing the color data DR, DG, and DB. When the pieces of color data DR, DG, and DB are processed without taking into consideration the vision characteristics, a color corresponding to color data whose phase is least corrected becomes striking in a black-and-white repeated-pattern portion where the spatial frequency is high (FIG. 5).

Therefore, the monitor 11 processes the color data DR, DG, and DB in the following manner (FIG. 2). The panel γ correction unit 18 corrects the shades of the color data DR, DG, and DB on the basis of the gamma of the LCD panel 14 and the gamma of the human visibility characteristics. Thereafter, the subpixel processor 19 performs a series of steps to prevent the coloring as well as a change in color depending on the viewing direction. Thereafter, the return γ correction unit 35 restores the original gamma. In this manner, the monitor 11 prevents a black-and-white repeated-pattern portion where the spatial frequency is high from being colored with a specific color.

(3) Advantages

With the above-described structure, the coloring of an edge or the like is prevented by correcting the phases of pieces of color data on the basis of the arrangement (positions) of subpixels in each pixel. The signal levels of the pieces of color data are corrected so as to correct the luminance levels of the subpixels, which change depending on the viewing direction. Accordingly, the coloring of the edge or the like is prevented by correcting the phases of the pieces of color data on the basis of the arrangement (positions) of the subpixels in each pixel, and the luminance level of each subpixel is prevented from changing depending on the viewing direction.

After the shades of the pieces of input color data are corrected on the basis of the gamma of an image display panel and the gamma of the human visibility characteristics and the phases of the pieces of input color data are corrected, the original shades are restored. Accordingly, the coloring of a repeated-pattern portion where the spatial frequency is high can be prevented.

Second Embodiment

Figure 7:
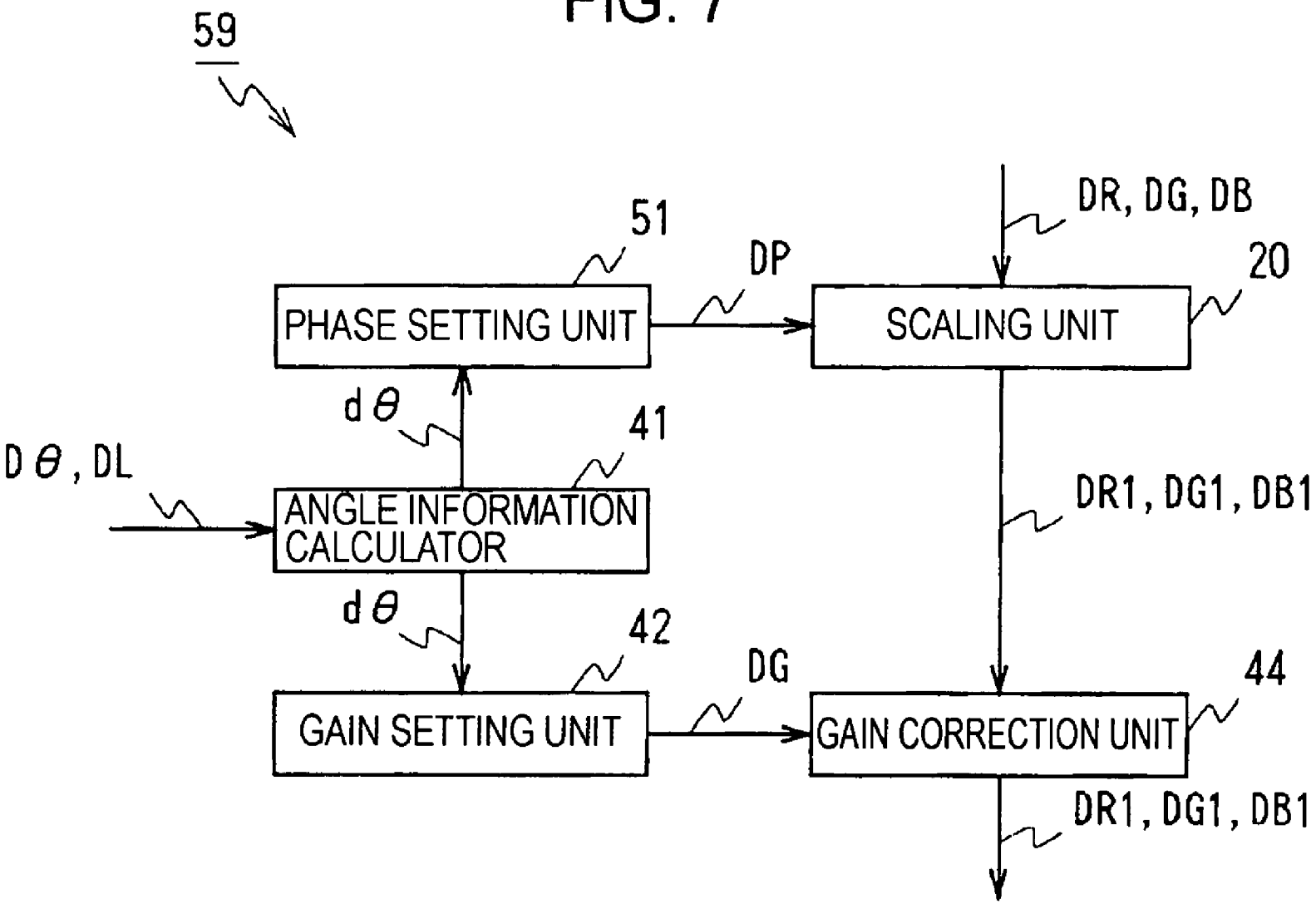
FIG. 7 is a block diagram showing a subpixel processor applied to a monitor according to a second embodiment of the present invention.

FIG. 7 is a block diagram showing the structure of a subpixel processor applied to a monitor according to a second embodiment of the present invention, which is in contrast to FIG. 1. The monitor according to the second embodiment has the same structure as that of the monitor 11 described above in the first embodiment except that the structure of a subpixel processor 59 in the monitor according to the second embodiment is different.

The subpixel processor 59 corrects the phases of color data DR, DG, and DB in a more detailed manner on the basis of the positions of subpixels, which change depending on the viewing direction.

That is, the image display panel of the LCD panel 14 or the like has a transparent plate member made of glass or the like, which is disposed on the front surface of the LCD panel 14. The viewer views an image displayed by the subpixels through the transparent plate member. Accordingly, light emitted from the subpixels via the transparent plate member to the eyes of the viewer passes a parallel plate including the transparent plate member diagonally. As a result, the optical path of light entering the transparent plate member becomes different from the optical path of light emitted from the transparent plate member in accordance with the thickness and refractive index of the transparent plate member and the direction of light diagonally entering the transparent plate member. Due to the difference in the optical path, the position of each subpixel changes depending on the viewing direction.

According to the second embodiment, a phase setting unit 51 in the subpixel processor 59 corrects the phases, which have been corrected on the basis of the positions of the subpixels included in each pixel in the first embodiment described above, on the basis of the subpixel positions changing depending on the viewing direction, and outputs the correction results serving as the phase data DP to the coefficient generator 22 of the scaling unit 20.

According to the second embodiment, in the structure of the first embodiment, interpolation coefficients used in interpolation performed by an interpolation operator are changed, and the phases of the pieces of output color data are corrected on the basis of the subpixel positions changing depending on the viewing direction. Accordingly, an image can be displayed more precisely.

In the above-described embodiments, the case has been described in which, with regard to the driving of an image display panel including subpixels that are sequentially and recursively arranged in the horizontal direction in a so-called in-line format, the coloring and a change in color depending on the viewing direction are prevented. However, the present invention is not limited to this case. Alternatively, the present invention may be applied to the driving of an image display panel including subpixels that are sequentially and recursively arranged in the horizontal and vertical directions in a so-called delta format, and the coloring and a change in color depending on the viewing direction may be prevented. In this case, it is necessary for the above-described scaling unit 20 or the like to perform the two-dimensional processing in the horizontal and vertical directions so as to correspond to the two-dimensional arrangement of the subpixels, which are sequentially and recursively arranged.

In the above-described embodiments, the case has been described in which the present invention is applied to a monitor using an LCD panel. However, the present invention is not limited to this case. For example, the present invention is widely applicable to monitors using various types of image display panels including PDPs, field emission displays (FEDs), and the like.

In the above-described embodiments, the case where each pixel includes red, green, and blue subpixels has been described. However, the present invention is not limited to this case. The present invention is widely applicable to, for example, the case where each pixel includes subpixels of four colors.

In the above-described embodiments, the case has been described in which the present invention is applied to a monitor with an image display panel. However, the present invention is not limited to this case. The present invention is widely applicable to various types of image display apparatuses outputting various types of image content based on color data and displaying images on monitors.

In the above-described embodiments, the case has been described in which video data is processed by the structure of hardware to display an image. However, the present invention is not limited to this case. The present invention is widely applicable to the case where an image is displayed by software processing using a program according to an embodiment of the present invention, such as an image display program in a computer. In this case, the program may be provided in the following manner. For example, the program may be installed in advance in an apparatus for performing the processing. Alternatively, the program may be recorded on a recording medium, such as an optical disk, a magnetic disk, or a memory card. Alternatively, the program may be downloaded via a network, such as the Internet.

It should be understood by those skilled in the art that various modifications, combinations, sub-combinations, and alterations may occur depending on design requirements and other factors insofar as they are within the scope of the appended claims or the equivalents thereof.

What is claimed is:

1. An image display apparatus for displaying an image on an image display panel having a plurality of pixels, each pixel including a plurality of subpixels of different colors, the apparatus comprising:

a color data converter operable to convert an image data signal into pieces of color input data, the pieces of color input data corresponding to the different colors of subpixels of the image display panel, wherein a subpixel is a component of a pixel;

an interpolation operator operable to interpolate consecutive sampling values of the pieces of input color data provided to the image display panel, wherein the consecutive sampling values are interpolated based on positions of subpixels within corresponding pixels with respect to the center of the corresponding pixel;

a coefficient generator to generate interpolation coefficients corresponding to the pieces of input color data and based on types of colors of the pieces of input color data;

a delay unit operable to hold the pieces of input color data for a clock cycle of a clocking signal;

multipliers operable to multiply the held pieces of input color data with the interpolation coefficients to generate multiplication outputs after the clock cycle;

an adder circuit operable to add the multiplication outputs to generate a sum, wherein the interpolation operator outputs pieces of output color data by correcting phases of the pieces of input color data based on the sum and positions of the subpixels in the pixels;

a correction unit operable to correct signal levels of the pieces of output color data based on predetermined gains;

an angle information calculator operable to calculate, for one of the pixels or for one of the subpixels, a direction of a viewer of the image display panel on the basis of a position of the viewer relative to the image display panel; and a gain setting unit operable to set the predetermined gains for the pieces of input color data to correct a luminance of the one subpixel, wherein the luminance level changes depending on a viewing direction of the viewer and the predetermined gains are set on the basis of a calculation result obtained by the angle information calculator.

2. The image display apparatus according to claim 1, further comprising a phase setting unit operable to set the phases of the pieces of output color data on the basis of the positions of the subpixels by changing the interpolation coefficients on the basis of the calculation result.

3. The image display apparatus according to claim 1, further comprising:

a gamma correction unit operable to correct shades of the pieces of input color data on the basis of gamma of the image display panel and gamma of human visibility characteristics and output pieces of shade-corrected color data to the interpolation operator; and a return gamma correction unit operable to correct the pieces of shade-corrected color data output from the gamma correction unit on the basis of additional characteristics.

4. An image display method of displaying an image on an image display panel having a plurality of pixels, each pixel including a plurality of subpixels of different colors, the method comprising the steps of:

converting an image data signal into pieces of color input data, the pieces of color input data corresponding to the different colors of subpixels of the image display panel, wherein a subpixel is a component of a pixel;

interpolating consecutive sampling values of the pieces of input color data provided to the image display panel, wherein the consecutive sampling values are interpolated based on positions of subpixels within corresponding pixels with respect to the center of the corresponding pixel;

generating interpolation coefficients corresponding to the pieces of input color data and based on types of colors of the pieces of input color data;

holding the pieces of input color data for a clock cycle of a clocking signal;

multiplying the held pieces of input color data with the interpolation coefficients to generate multiplication outputs after the clock cycle;

adding the multiplication outputs to generate a sum;

generating pieces of output color data by correcting phases of the pieces of input color data based on the sum and positions of the subpixels in the pixels;

correcting signal levels of the pieces of output color data based on predetermined gains;

calculating, for one of the pixels or for one of the subpixels, a direction of a viewer of the image display panel on the basis of a position of the viewer relative to the image display panel; and setting the predetermined gains for pieces of input color data to correct a luminance level of the one subpixel, wherein the luminance level changes depending on a viewing direction of the viewer and the predetermined gains are set based on the calculated direction.

5. A non-transitory computer-readable storage medium storing a program that, when executed on a processor of an image display panel having a plurality of pixels, each pixel including a plurality of subpixels of different colors, causes the processor to perform a method comprising:

converting an image data signal into pieces of color input data, the pieces of color input data corresponding to the different colors of subpixels of the image display panel, wherein a subpixel is a component of a pixel;

interpolating consecutive sampling values of the pieces of input color data provided to the image display panel, wherein the consecutive sampling values are interpolated based on positions of subpixels within corresponding pixels with respect to the center of the corresponding pixel;

generating interpolation coefficients corresponding to the pieces of input color data and based on types of colors of the pieces of input color data;

holding the pieces of input color data for a clock cycle of a clocking signal;

multiplying the held pieces of input color data with the interpolation coefficients to generate multiplication outputs after the clock cycle;

adding the multiplication outputs to generate a sum;

generating pieces of output color data by correcting phases of the pieces of input color data based on the sum and positions of the subpixels in the pixels;

correcting signal levels of the pieces of output color data based on predetermined gains;

calculating, for one of the pixels or for one of the subpixels, a direction of a viewer of the image display panel on the basis of a position of the viewer relative to the image display panel; and setting the predetermined gains for pieces of input color data to correct a luminance level of the one subpixel, wherein the luminance level changes depending on a viewing direction of the viewer and the predetermined gains are set based on the calculated direction.

6. A non-transitory recording medium having recorded thereon a program for allowing a processor to execute an image display method of displaying an image on an image display panel having a plurality of pixels, each pixel including a plurality of subpixels of different colors, the method comprising:

converting an image data signal into pieces of color input data, the pieces of color input data corresponding to the different colors of subpixels of the image display panel, wherein a subpixel is a component of a pixel;

interpolating, from video data, consecutive sampling values of the pieces of input color data provided to the image display panel based on a clocking signal, wherein the consecutive sampling values are interpolated based on positions of subpixels within corresponding pixels with respect to the center of the corresponding pixel;

generating interpolation coefficients corresponding to the pieces of input color data and based on types of colors of the pieces of input color data;

holding the pieces of input color data for a clock cycle of a clocking signal;

multiplying the held pieces of input color data with the interpolation coefficients to generate multiplication outputs after the clock cycle;

adding the multiplication outputs to generate a sum;

generating pieces of output color data by correcting phases of the pieces of input color data based on the sum and positions of the subpixels in the pixels;

correcting signal levels of the pieces of output color data based on predetermined gains;

calculating, for one of the pixels or for one of the subpixels, a direction of a viewer of the image display panel on the basis of a position of the viewer relative to the image display panel; and setting the predetermined gains for pieces of input color data to correct a luminance level of the one subpixel by amplifying the luminance level, wherein the luminance level changes depending on a viewing direction of the viewer and the predetermined gains are set based on the calculated direction.

* * * * *